US009613764B1

(12) United States Patent
Pal

(10) Patent No.: US 9,613,764 B1
(45) Date of Patent: Apr. 4, 2017

(54) CONTACTOR BODY WITH INTEGRAL HEAT SINK

(71) Applicant: Hamilton Sundstrand Corporation, Charlotte, NC (US)

(72) Inventor: Debabrata Pal, Hoffman Estates, IL (US)

(73) Assignee: HAMILTON SUNDSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 14/855,875

(22) Filed: Sep. 16, 2015

(51) Int. Cl.

| | |
|---|---|
| ***H01H 3/00*** | (2006.01) |
| ***H01H 1/62*** | (2006.01) |
| ***H01H 50/12*** | (2006.01) |
| ***H01H 51/00*** | (2006.01) |

(52) U.S. Cl.
CPC ..... *H01H 1/62* (2013.01); *H01H 50/12* (2013.01); *H01H 51/00* (2013.01)

(58) Field of Classification Search
CPC ..... H01H 1/62; H01H 50/12; H01H 51/00
See application file for complete search history.

(56) References Cited

U.S. PATENT DOCUMENTS

| | | | | |
|---|---|---|---|---|
| 5,337,214 A * | 8/1994 | Lindsey | H05K 7/209 174/16.3 |
| 5,486,972 A * | 1/1996 | Taylor | H01H 47/007 361/142 |
| 7,837,496 B1 * | 11/2010 | Pal | H01R 9/2466 361/712 |
| 9,142,364 B2 * | 9/2015 | Pal | H01H 1/62 |
| 2016/0172126 A1 * | 6/2016 | Pal | H01H 1/5805 200/292 |

* cited by examiner

*Primary Examiner* — Bernard Rojas
(74) *Attorney, Agent, or Firm* — Cantor Colburn LLP

(57) ABSTRACT

An electrical contactor assembly is provided including an electrical contactor positioned within a contactor housing, an electrical bus bar, and a post constructed from an electrically and thermally conductive material connected to the bus bar. At least one lead is coupled to the electrical contact and to the post. The at least one lead has a first portion oriented about a first plane and a second portion extending from the first portion and being oriented about a second plane. The second plane is arranged at an angle to the first plane such that one or more surface of the at least one lead are configured to transmit heat to the contactor housing.

14 Claims, 6 Drawing Sheets

CONTACTOR BODY WITH INTEGRAL HEAT SINK

BACKGROUND

This invention generally relates to the field of electrical contactors and, more particularly, to an electrical contactor mounting assembly which is capable of dissipating heat into a mounting panel.

Contactor assemblies are used in electrical applications, such as aircraft power distribution systems, where power and current flow control of a multi-phase power distribution system is required. A primary power distribution assembly typically has a panel on which several electrical contactors are mounted. Known mounting assemblies used to mount electrical contactors to the panels are constructed of thermally and electrically resistive materials, such as plastics, FR-4 or other woven resin fabric materials.

Each of the contactors is connected to an electrical bus bar, and allows current to flow through the contactor and the corresponding bus bar whenever the contactor is in a closed position. The electrical power and current flow through the contactors is controlled by mechanically actuating a contact plate within the contactor such that, when current flow is desired to pass through the contactor, the contact plate is pushed into electrical contact with two leads and forms an electrical path coupling the leads, thereby allowing current to flow through it. Due to the amount of current traveling from the leads to the connector, waste heat is generated at the contact points and should be removed in order to prevent heat buildup. Additional factors such as imperfections in the contact surfaces of other imperfections can add to the amount of waste heat generated.

To dissipate the waste heat, previous known contactor mounting assemblies use thermally conductive electrical connections to allow the heat from the contact to be transmitted to the bus bars connected to each of the contactor's leads. The bus bars then dissipate heat into the atmosphere using natural convection and radiation techniques.

BRIEF DESCRIPTION

According to one embodiment, an electrical contactor assembly is provided including an electrical contactor positioned within a contactor housing, an electrical bus bar, and a post constructed from an electrically and thermally conductive material connected to the bus bar. At least one lead is coupled to the electrical contact and to the post. The at least one lead has a first portion oriented about a first plane and a second portion extending from the first portion and being oriented about a second plane. The second plane is arranged at an angle to the first plane such that one or more surface of the at least one lead are configured to transmit heat to the contactor housing.

According to another embodiment, a lead configured for use in a contactor assembly is provided including a body having a first portion and a second portion. The second portion extends at an angle to the first portion. The first portion is configured to couple a contactor and a bus bar and the second portion is configured to connect to a surface of a contactor housing.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
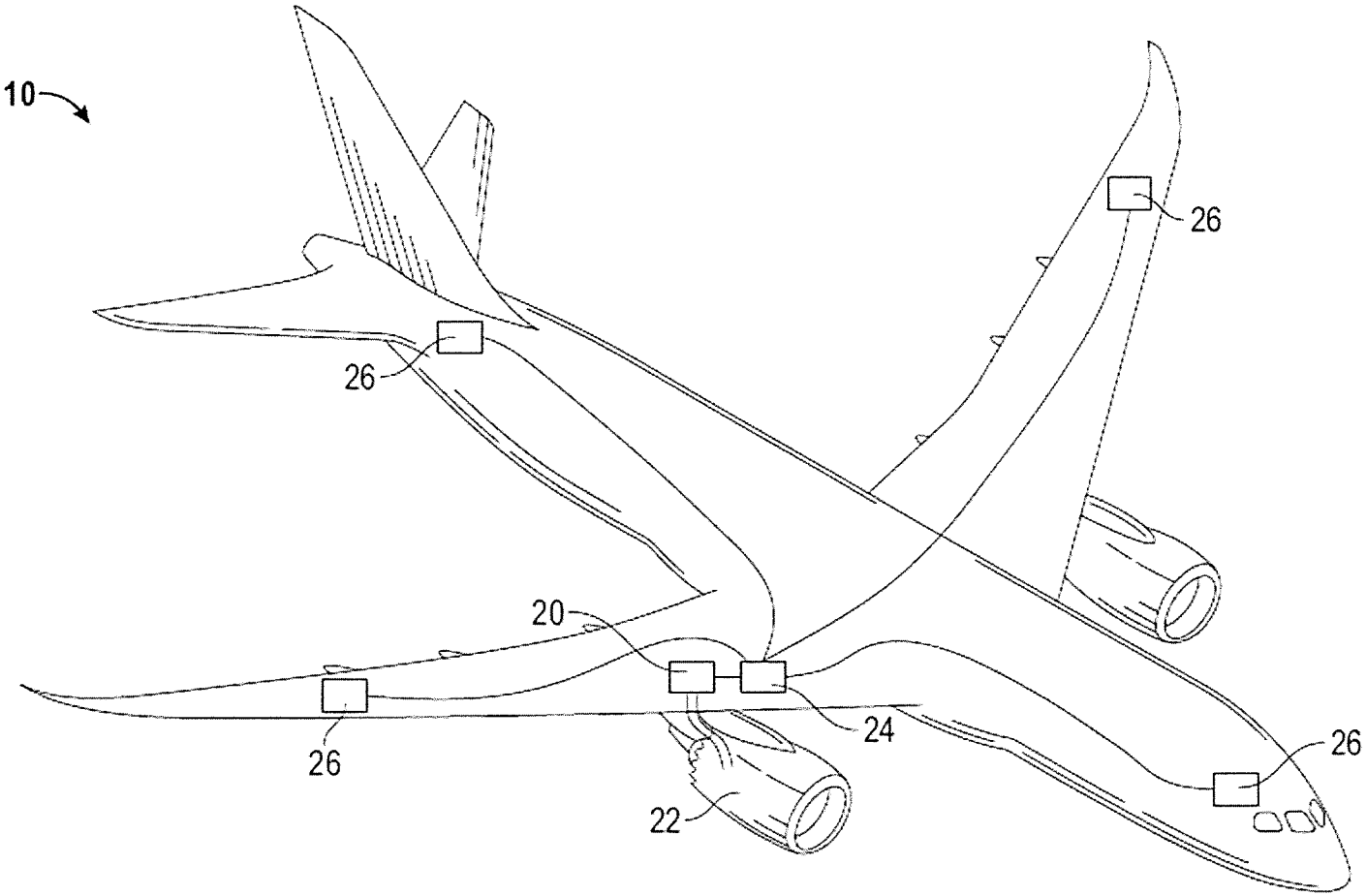
FIG. 1 is a schematic diagram of an aircraft.

Referring now to FIG. 1, an aircraft 10 including an electrical power distribution system is illustrated. The aircraft 10 includes a power generation system 20, which utilizes rotation within the jet engines 22 to generate either single phase or three phase electrical power. The power is sent to a panel box 24 that contains multiple electrical buses and contactor assemblies for controlling how the power is distributed throughout the aircraft 10. Through the use of the electrical contactor assemblies, power may be controlled for each onboard electrical system 26 independently.

Figure 2:
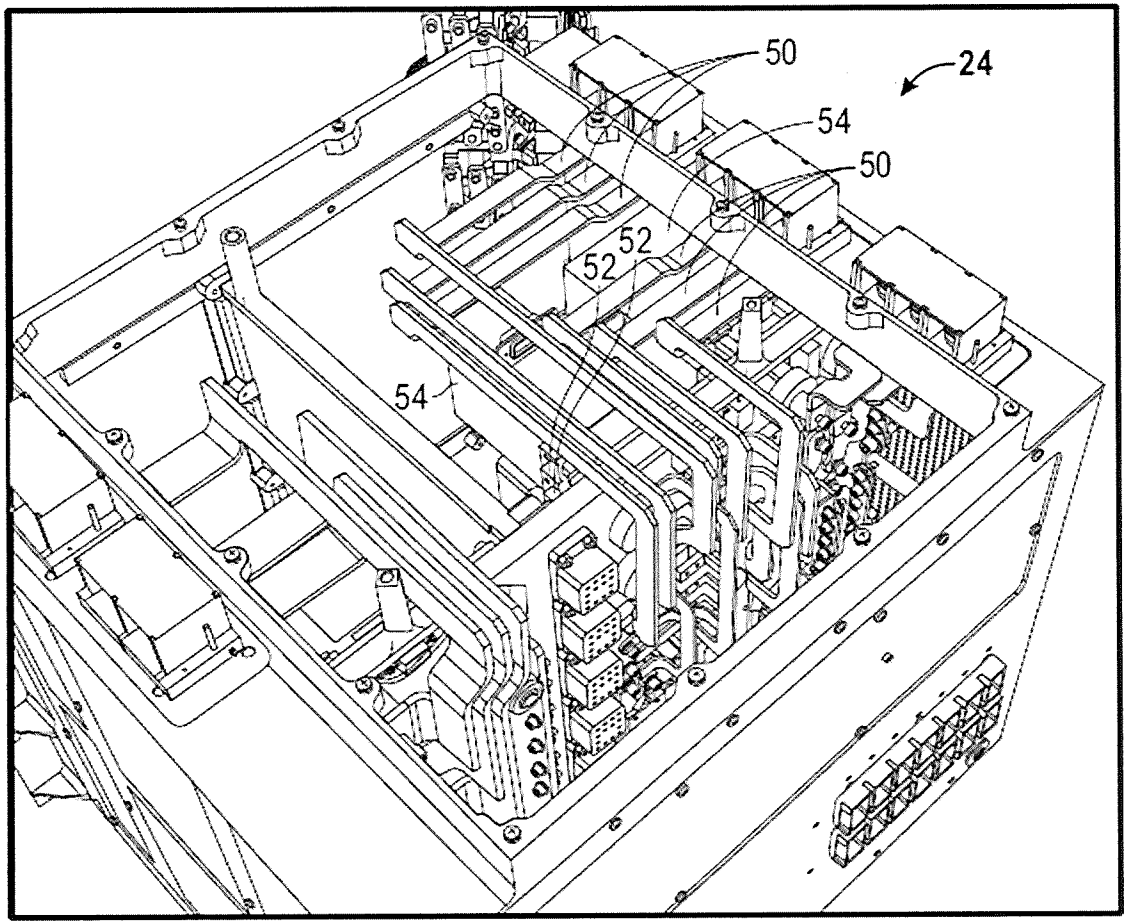
FIG. 2 is a schematic diagram of a portion of an exemplary power distribution network.

The interior of an exemplary panel box 24 is illustrated in FIG. 2. The interior of the panel box 24 has multiple electrical bus bars 50, which are interrupted by electrical contactor connections 52. When the contactor connections 52 are closed, electrical current and heat are allowed to flow between the connected bus bars 50 and a contactor 54. In known systems, all of the excess heat generated in the contactors 54 is transmitted to the bus bars 50 for dissipation by natural convection and radiation into the ambient atmosphere.

Figure 3:
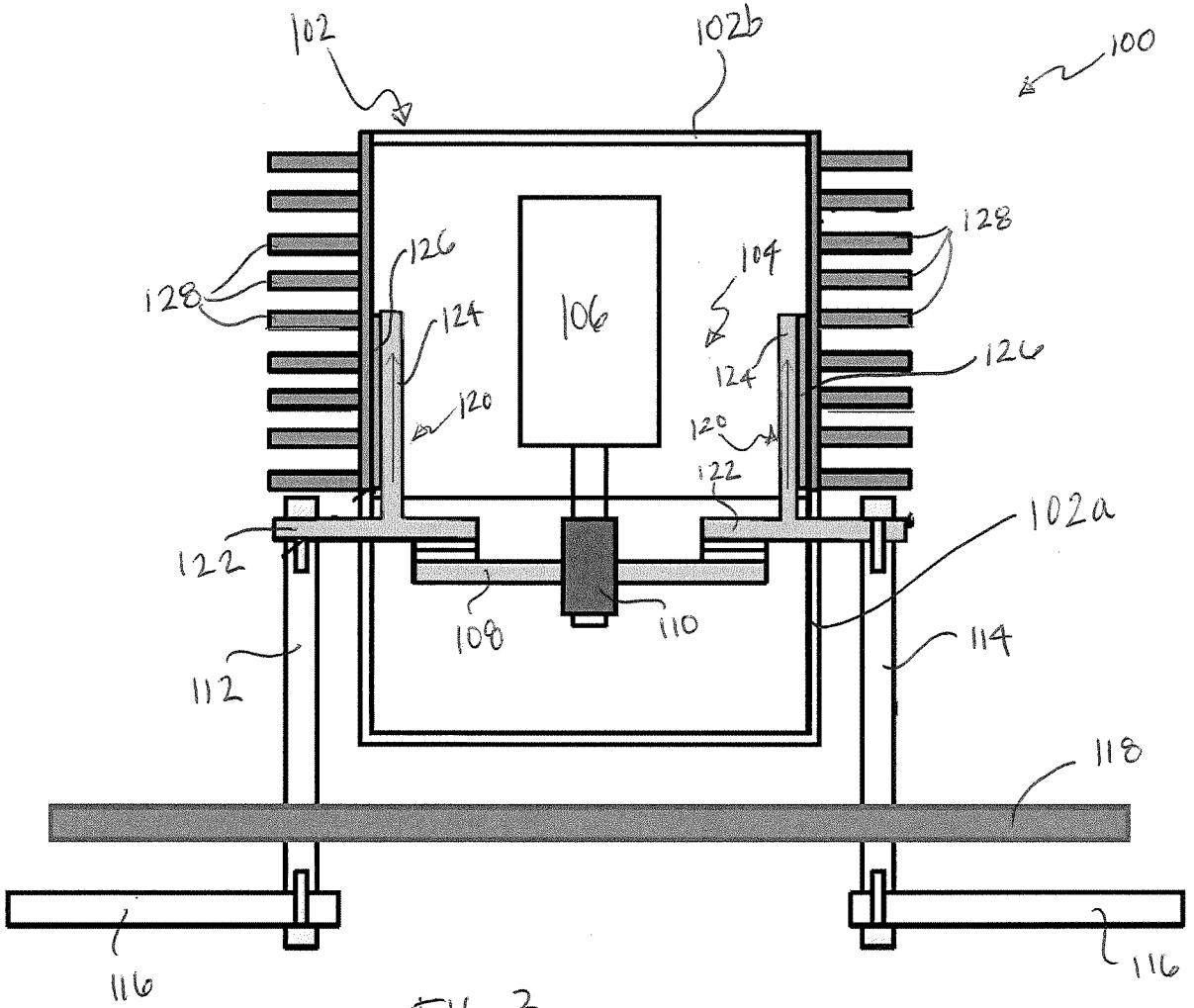
FIG. 3 is a cross-sectional view of a contactor assembly in a power distribution network according to an embodiment of the invention.

Referring now to FIG. 3, an example of a contactor assembly 100 including a contactor housing 102 and an electrical contactor 104 coupled to at least one bus bar 116 is illustrated. As shown, the contact housing 102 includes a bottom portion 102*a* and a complementary top portion 102*b* which are configured to couple to at least partially enclose the electrical contactor 104. The top portion 102*b* may be formed from a conductive material, such as a metal, for example aluminum. The bottom portion 102*a* of the housing 102 may be formed from a generally electrically insulated material, such as a plastic material. In the illustrated, non-limiting embodiment, the electrical contactor 104 includes a solenoid 106 connected to a moveable bus bar 108 via an insulator 110. The contactor assembly 100 additionally includes one or more posts 112 configured to couple the electrical contactor 104 to a first side 116*a* of an external bus bar 116, and one or more posts 114 configured to couple the contactor 104 to a second side 116*b* of the external bus bar 116. The posts 112, 114 are electrically and thermally coupled to the bus bar 116. Bus bars 116 are the main heat transfer path from the contactor 104 to the ambient air. A panel 118, positioned generally adjacent the bus bars 116, includes a plurality of holes (not shown) through which the posts 112, 114 extend. When the posts 112, 114 directly contact the panel 118, the thermal conductivity of the posts 112, 114 allows heat to transfer from the contactor 104 to the panel 118. Heat within the panel 118 is configured to dissipate into the surrounding air via radiation and convection in the same manner as the heat being dissipated by the bus bar 116 in known systems.

The electrical contactor 104 connects to the posts 112, 114 of the connector assembly 100 via a set of electrical leads 120 using known thermal and electrical connection techniques. As illustrated in the FIGS., the electrical leads 120 have a plurality of integrally formed or coupled three-dimensional portions arranged at an angle to one another in a non-planar configuration such that one or more surfaces of each portion of the electrical leads 120 is configured to transmit at least one of electricity and heat to other components of the assembly 100.

Figure 4:
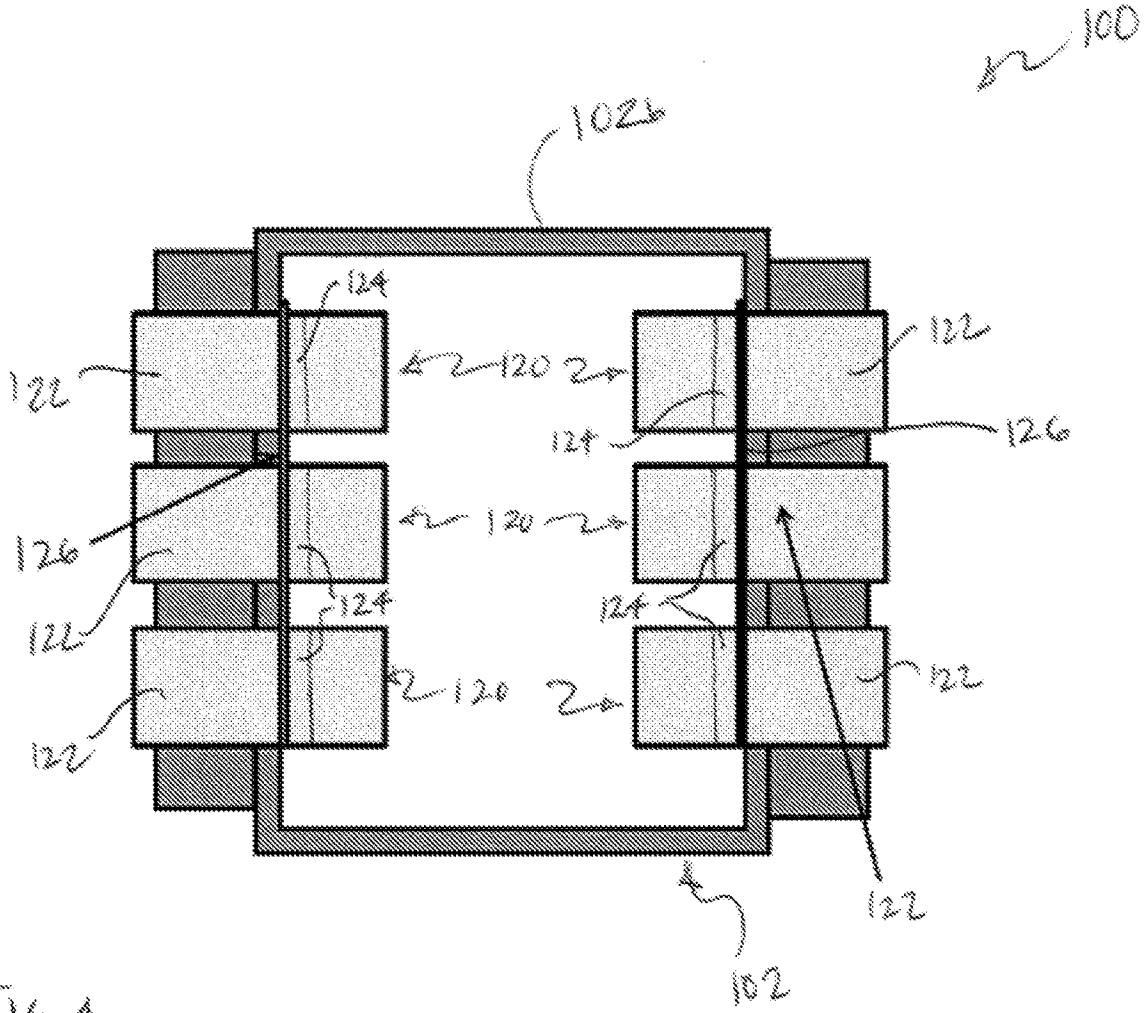
FIG. 4 is a top view of the contactor assembly of FIG. 3 according to an embodiment of the invention.

For example, in the illustrated, non-limiting embodiment of FIGS. 3 and 4, the leads 120 are shaped like an inverted "T." As shown, a horizontally oriented first portion 122 of the leads 120 is configured to electrically and thermally couple the contactor 104 to the posts 112, 114. A second portion 124 of the leads 120 extends generally perpendicular to the first portion 122. As shown, the second portion 124 is spaced away from the ends of the first portion 122, but is offset from the center thereof; however the first and second portion 122, 124 may be arranged at any position relative to one another. Further, although the second portion 124 is illustrated as being arranged perpendicular to the first portion 120, embodiments where the second portion is at another, non-zero angle are within the scope of the disclosure.

The vertically oriented second portion 124 is arranged in contact with an adjacent surface of the contactor housing 102, such as the top portion 102*b* for example. In one embodiment, an insulative material 126 is positioned between the second portion 124 of the leads 120 and the contactor housing 102. The insulative material 126 may be any thermally conductive, electrically insulative material 126 such that heat, and not electricity, from the contactor 104 is transferred to the housing 102. By thermally coupling the contactor 104 to the housing 102, the large surface area of the housing 102 may be used to efficiently dissipate heat from the assembly 100.

The contactor housing 102 may additionally include a thermal feature, such as a plurality of cooling fins 128 for example, mounted to one or more surfaces thereof. In one embodiment, cooling fins 128 are mounted to at least the surfaces of the housing 102 coupled to the leads 120. The fins 128 may be formed as a separate component attached to the housing 102, or alternatively, may be formed integrally with the material of the housing 102. The cooling fins 128 provide additional surface area from which heat may be dissipated, thereby increasing the cooling efficiency of the housing 102.

Figure 5:
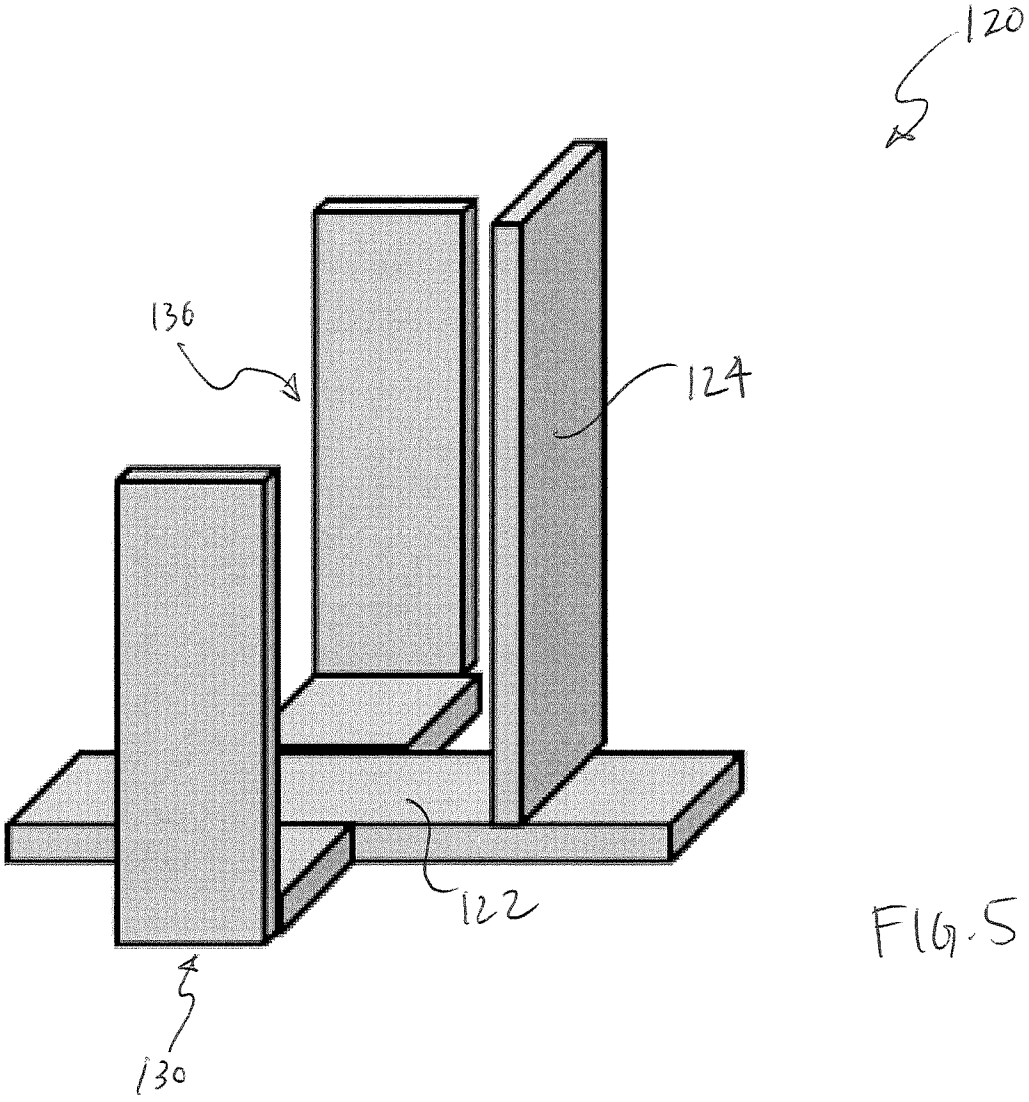
FIG. 5 is a perspective view of a lead configured for use in a contactor assembly according to an embodiment of the invention.
Figure 6:
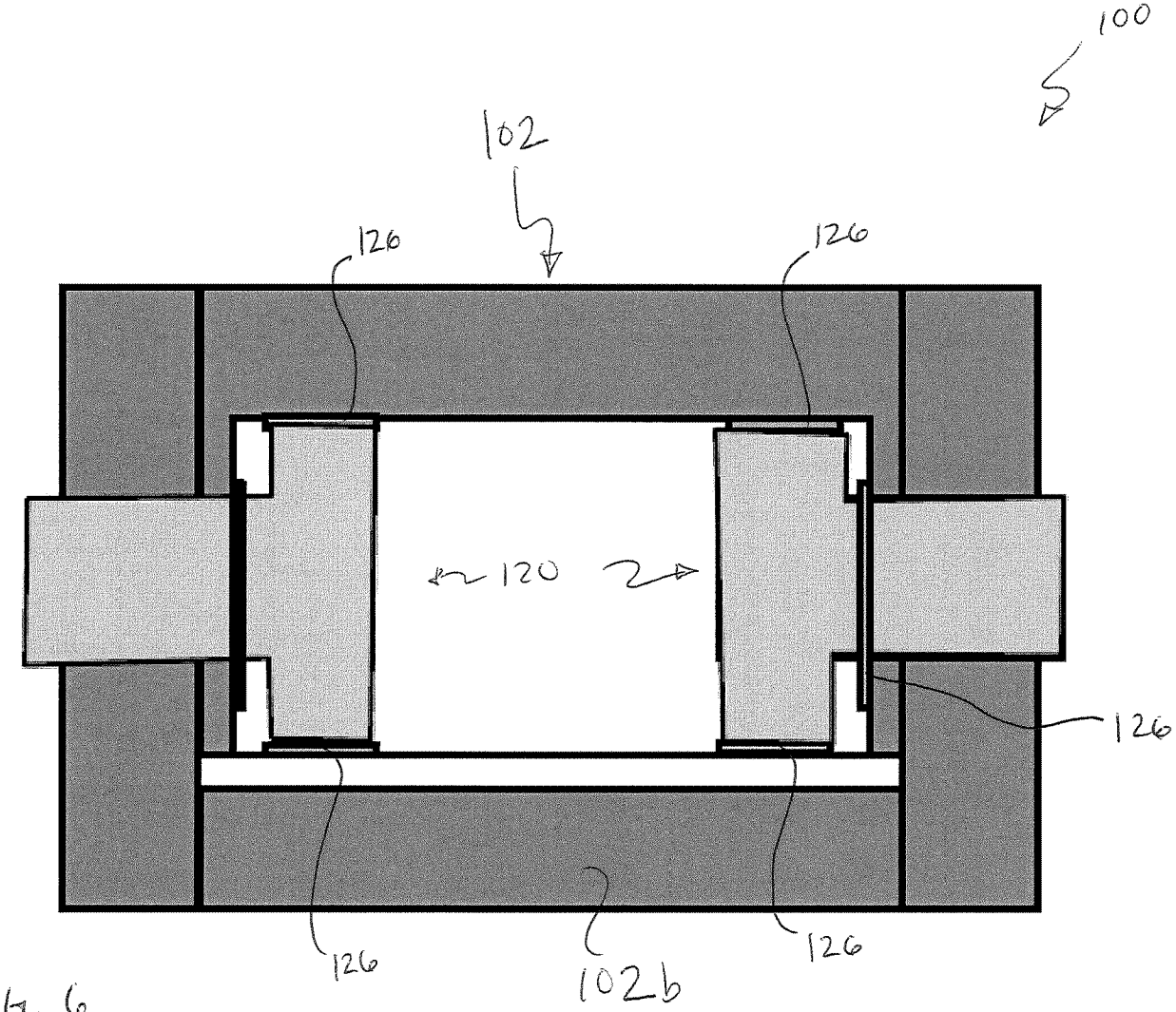
FIG. 6 is a perspective view of the lead of FIG. 5 mounted in a contactor assembly of a power distribution network according to an embodiment of the invention.

Another lead 120 having multiple three-dimensional portions arranged at an angle to one another in a non-planar configuration is illustrated in FIGS. 5 and 6. The lead 120 includes a complex shape having a horizontally oriented first portion 122, and a perpendicular second portion 124, as previously described. As shown, the lead 120 may include one or more portions having additional surfaces configured to couple to one or more components of a contactor assembly 100. In the illustrated, non-limiting embodiment, the lead 120 includes two substantially identical L-shaped portions 130 extending from opposing sides of the first portion 122. The L-shaped portions 130 extend horizontally and vertically such that the lead 120 is substantially symmetrical about a vertical plane. When the lead 120 of FIG. 5 is mounted within a contactor assembly 100, as shown in FIG. 6, the second portion 124, and at least one surface of the L-shaped portions 130 extending generally parallel to the second portion 124 are arranged in indirect contact with a surface of the contactor housing 102 via the insulative material 126. As a result, in the illustrated embodiment, the lead 120 is configured to contact three different surfaces of the housing, thereby distributing the heat transferred thereto for improved dissipation. It should be understood to a person having ordinary skill in the art that the non-planar leads illustrated and described herein are intended as example only, and leads 120 having other non-planar configurations are within the scope of the disclosure.

Modifying the leads 120 to have a non-planar configuration improves the heat dissipation capability of the contactor assembly 100. As a result of this more efficient heat transfer, the bus bars 116 of the assembly 100 may be reduced to the size required to transfer electrical current to a load and need not be sized to also dissipate heat. By improving the heat dissipation of the contactor assembly 100, the size and weight, and therefore the cost of the contactor assembly 100 are all reduced.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An electrical contactor assembly comprising:

an electrical contactor positioned within a contactor housing;

an electrical bus bar;

a post constructed from an electrically and thermally conductive material and connected to the electrical bus bar; and at least one lead coupled to the electrical contactor and the post, the at least one lead having a contiguous first portion oriented about a first plane, the first portion having a first end and a second end, the first end coupled to the electrical contactor, the second end coupled to the post, and a second portion extending from the first portion between the first end and the second end and being oriented about a second plane, the second plane being arranged at an angle to the first such that one or more surfaces of the at least one lead are configured to transmit heat to the contactor housing.

2. The electrical contactor assembly according to claim 1, wherein the first portion is oriented about a horizontal plane and the second portion is oriented about a vertical plane.

3. The electrical contactor assembly according to claim 1, wherein an insulative material is positioned between the lead and the contactor housing.

4. The electrical contactor assembly according to claim 1, further comprising at least one cooling fin mounted to a portion of the contactor housing.

5. The electrical contactor assembly according to claim 4, wherein the at least one cooling fin is mounted to the portion of the contactor housing adjacent the at least one lead.

6. The electrical contactor assembly according to claim 4, wherein the at least one cooling fin is mounted to the contactor housing.

7. The electrical contactor assembly according to claim 4, wherein the at least one cooling fin is integrally formed with the contactor housing.

8. The electrical contactor assembly according to claim 1, wherein the contactor housing includes a top portion and bottom portion, the second portion of the at least one lead being arranged in contact with a surface of the top portion.

9. The electrical contactor assembly according to claim 8, wherein the lead further comprises a third portion configured to couple to another surface of the contactor housing.

10. The electrical contactor assembly according to claim 9, wherein the third portion of the at least one lead is arranged in contact with another surface of the top portion.

11. A lead configured for use in a contactor assembly, comprising:

a body including a contiguous first portion, the first portion having a first end and a second end, the first end configured to couple to a contactor, the second end configured to couple to a bus bar, and a second portion configured to connect to a surface of a contactor housing, the second portion extending at an angle to the first portion and disposed between the first end and the second end.

12. The lead according to claim 11, wherein the first portion is oriented generally horizontally and the second portion is oriented generally vertically.

13. The lead according to claim 11, wherein only heat is configured to transfer from the second portion to the contact housing.

14. The lead according to claim 11, further comprising a third portion configured to couple to another surface of the contactor housing.

* * * * *